US005538070A

United States Patent [19]

Phillips et al.

[11] Patent Number: 5,538,070

[45] Date of Patent: Jul. 23, 1996

[54] MOULD FLUXES AND THEIR USE IN THE CONTINUOUS CASTING OF STEEL

[75] Inventors: Royston J. Phillips, Strongsville; Spencer C. Diehl, North Olmsted, both of Ohio

[73] Assignee: Foseco International Limited, Birmingham, England

[21] Appl. No.: 411,651

[22] PCT Filed: Aug. 15, 1994

[86] PCT No.: PCT/GB94/01781

§ 371 Date: Apr. 5, 1995

§ 102(e) Date: Apr. 5, 1995

[87] PCT Pub. No.: WO95/05911

PCT Pub. Date: Mar. 2, 1995

[30] Foreign Application Priority Data

Aug. 26, 1993 [GB] United Kingdom ..... 9317720

[51] Int. Cl.[6] ..... C21C 7/076

[52] U.S. Cl. ..... 164/473; 148/26; 75/305

[58] Field of Search ..... 164/473, 472; 148/23, 26; 75/305, 327, 329, 309, 310

[56] References Cited

U.S. PATENT DOCUMENTS

| | | | |
|---|---|---|---|
| 4,221,595 | 9/1980 | Zebrowski | 106/56 |
| 4,321,154 | 3/1982 | Ledru | 252/62 |
| 4,561,912 | 12/1985 | Courtenay et al. . | |
| 4,785,872 | 11/1988 | Koul et al. | 164/56.1 |
| 5,240,492 | 8/1993 | Phillips et al. | 75/305 |

FOREIGN PATENT DOCUMENTS

| | | |
|---|---|---|
| 510842 | 10/1992 | European Pat. Off. . |
| 223378 | 6/1985 | Germany . |
| 246260 | 6/1987 | Germany . |
| 277856 | 4/1990 | Germany . |
| 59-7466 | 1/1984 | Japan . |

OTHER PUBLICATIONS

*The Making, Shaping and Treating of Steel*, USS. edited by McGannon (1971) pp. 240–243.

*Primary Examiner*—Joseph J. Hail, III
*Assistant Examiner*—Randolph S. Herrick
*Attorney, Agent, or Firm*—Nixon & Vanderhye

[57] ABSTRACT

A granular mould flux for use in the continuous casting of steel comprises refractory metal oxide, one or more fluxing agents, a binder and 0.1% to 3% by weight based on the weight of the flux of an expanding agent such as expandable perlite, expandable vermiculite or expandable graphite.

10 Claims, No Drawings

MOULD FLUXES AND THEIR USE IN THE CONTINUOUS CASTING OF STEEL

This invention relates to mould fluxes and their use in the continuous casting of steel.

In the continuous casting of steel a mould flux is generally added to the surface of the molten steel in the mould. The flux provides lubrication between the mould wall and the steel, it reduces the loss of heat from the surface of the steel, it protects the surface from oxidation, and it may remove impurities such as alumina from the steel.

As granules evolve much less dust compared with powder, mould fluxes used in the continuous casting of steel are often used in the form of granules, which may be produced by, for example, spray-drying of the flux constituents. The excellent flowability of granules makes them particularly suitable for automatic feeding to the mould, for example, using a DAPSOL (trade mark) feeder. However once the flux is in the mould the flowability of the granules becomes a disadvantage since the granules tend to find their own level under high rates of flow of steel into the mould and the surface of the steel may become exposed in the corners of the mould.

It has now been found that the above problem can be alleviated if the granules contain a minor mount of an expandable material which will expand under the action of heat and will cause the granules to break down into powder on the surface of the steel.

According to the invention there is provided a granular mould flux comprising refractory metal oxide, one or more fluxing agents, a binder and an expanding agent, the expanding agent being present in an amount of 0.1% to 3% by weight based on the weight of the flux.

According to a further feature of the invention there is provided a method of continuously casting molten steel in a mould the method comprising adding to the mould prior to, during or after teeming of the molten steel a granular mould flux comprising one or more refractory metal oxides, one or more fluxing agents, a binder and an expanding agent, the expanding agent being present in an amount of 0.1% to 3% by weight based on the weight of the flux.

The refractory metal oxide is preferably made up of calcium oxide and silica but alumina and/or magnesia may also be present. Materials such as blast furnace slag which contains calcium oxide, silica and alumina, or feldspar (sodium potassium aluminium silicate) which contains alumina and silica may be used as a source of refractory metal oxides.

Wollastonite, which contains calcium oxide and silica, is a particularly useful component since it is capable of absorbing appreciable amounts of alumina from the steel into the flux without significantly affecting the viscosity or melting point of the flux. The wollastonite component may be, for example, a synthetic or natural calcium monosilicate (which may contain very small quantities of iron oxide and/or alumina), or it may be calcium monosilicate in solid solution with at least one of silica, calcium oxide or alumina, for example, a solid solution containing pseudo-wollastonite or rankinite.

The fluxing agent may be, for example, one or more of sodium carbonate, potassium carbonate, lithium carbonate, barium carbonate, sodium fluoride, aluminium fluoride, potassium fluoride, cryolite, fluorspar, manganese dioxide and olivine. The fluxing agent reduces the melting point of the flux and by the selection of particular fluxing agents and amounts the variation of the viscosity of the flux with temperature can be controlled.

The binder may be any suitable binder which will maintain the integrity of the granules from manufacture through storage, transport and use up to the point of expansion of the expanding agent when it is necessary for the granules to disintegrate back into the original powder form. Examples of suitable binders include resins, gums such as a polysaccharide gum and carbohydrate materials such as molasses.

The expanding agent may be, for example, expandable perlite, expandable vermiculite or expandable, e.g. acid-heated, graphite. The expanding agent is preferably present in an amount of 0.3% to 1.5% by weight based on the weight of the flux and is preferably expandable graphite.

The flux may also contain a light-weight refractory material such as expanded perlite, expanded vermiculite, or pumice, to lower the overall density of the flux.

The flux may also contain a carbonaceous material, (in addition to any expandable graphite which may be present as the expanding agent), such as charcoal, coke, anthracite, graphite or carbon black, to control the melting rate and sintering characteristics of the flux.

The flux will usually contain 45% to 90% refractory metal oxide, 10% to 50% by weight of fluxing agent, 0.05% to 10% by weight of binder, 0% to 10% by weight of light-weight refractory material, and 1% to 6% by weight of carbonaceous material other than expandable graphite.

The application rate of the mould flux to the mould will usually be in the range of 0.3 kg/tonne to 1.1 kg/tonne of steel cast.

The granules may be produced by a method such as pan granulation but they are preferably in the form of substantially spherical granules produced by spray drying an aqueous slurry of a mixture of the flux constituents. The granules are preferably in the size range of from 0.1 mm to 1 mm in diameter.

As stated previously the granular mould flux of the invention breaks down in contact with the steel in the mould producing a powder layer of flux on the surface and preventing exposure of the steel in the mould corners. Additionally the granular mould flux of the invention retains the advantages of known granular mould fluxes such as greater homogeneity compared with powder flux compositions, low dust production and excellent flowability for ease of automatic application.

The following examples will serve to illustrate the invention:

EXAMPLE 1

Substantially spherical granules of size 0.1 mm to 0.8 mm diameter were produced by spray drying an aqueous slurry having the following constituents:

| | % by weight |
|---|---|
| Sodium carbonate | 9.75 |
| Fluorspar | 21.56 |
| Calcium silicate | 37.99 |
| Expanded perlite | 4.11 |
| Graphite | 1.13 |
| Carbon black | 1.23 |
| Manganese dioxide | 7.70 |
| Sodium potassium aluminium silicate | 10.78 |
| Barium carbonate | 5.13 |
| Expandable graphite | 0.52 |
| Polysaccharide gum | 0.10 |

The granules were added to a mould in which steel slab was continuously cast at a temperature of 1520° C. at a rate of 0.6 kg/tonne. The granules readily broke down to form a complete powder cover on the surface of the steel, and the slab produced was clean and defect free.

EXAMPLE 2

A granular mould flux (A) according to the invention was used in comparison with a granular mould flux (B) not according to the invention. The compositions, by weight, of the two fluxes were as follows:

| | (A) % | (B) % |
|---|---|---|
| Calcium silicate | 50.9 | 50.7 |
| Carbon black | 3.3 | 3.3 |
| Sodium fluoride | 9.8 | 9.8 |
| Calcium fluoride | 7.8 | 7.8 |
| Olivine | 5.9 | 5.9 |
| Feldspar | 7.8 | 7.8 |
| Alumina | 1.5 | 1.5 |
| Graphite | — | 1.0 |
| Lithium carbonate | 1.0 | 1.0 |
| Sodium carbonate | 11.2 | 11.1 |
| Polysaccharide gum | 0.1 | 0.1 |
| Expandable graphite | 0.7 | — |

Flux (B) was in regular use on a continuous casting plant and under most conditions provided excellent lubrication between the mould wall and the steel. However, in exceptional circumstances when, due to flushing of the tundish nozzle, a rapid steel level rise took place in the mould, inadequate lubrication was provided, and sticking of the cast steel to the mould sometimes occurred.

Modification of the flux composition as in flux (A), i.e. by replacing the 1% by weight graphite with 0.7% by weight expandable graphite and making up the balance with an additional 0.2% by weight of calcium silicate and 0.1% by weight of sodium carbonate gave an improvement in performance in that sticking did not occur during rapid rises of the steel in the mould. This improvement is believed to be attributable to flux (A) not running away so rapidly from the high spot and thus better maintaining the integrity of the lubricating layer of flux over the steel.

We claim:

1. A granular mould flux comprising:

refractory metal oxide;

a binder;

a fluxing agent comprising one or more of sodium carbonate, potassium carbonate, lithium carbonate, barium carbonate, sodium fluoride, aluminium fluoride, potassium fluoride, cryolite, fluorspar, managanese dioxide, and olivine; and 0.1–3% by weight based on the weight of the mould flux of an expanding agent;

said granular flux being in the form of spherical granules produced by spray drying an aqueous slurry of a mixture of the flux constituents, and in the size range of 0.1 mm to 1 mm in diameter.

2. A granular mould flux as recited in claim 1 wherein said expandable graphite is present in an amount of 0.3–1.5% by weight.

3. A granular mould flux as recited in claim 1 further comprising a carbonaceous material other than expandable graphite.

4. A granular mould flux as recited in claim 3 wherein said flux contains:

45–90% by weight refractory metal oxide;

10–50% by weight of fluxing agent;

0.05–10% by weight binder;

0–10% by weight of light weight refractory material; and

1–6% by weight of carbonaceous material other than expandable graphite.

5. A granular mould flux as recited in claim 1 wherein said flux contains:

45–90% by weight refractory metal oxide;

10–50% by weight of fluxing agent;

0.05–10% by weight binder;

0–10% by weight of light weight refractory material; and

1–6% by weight of carbonaceous material other than expandable graphite.

6. A granular mould flux as recited in claim 5 further comprising more than zero light weight refractory material.

7. A granular mould flux as recited in claim 1 wherein said binder is a resin, a gum, or a carbohydrate material.

8. A granular mould flux as recited in claim 7 further comprising a carbonaceous material other than expandable graphite.

9. A granular mould flux as recited in claim 8 wherein said flux contains:

45–90% by weight refractory metal oxide;

10–50% by weight of fluxing agent;

0.05–10% by weight binder;

0–10% by weight of light weight refractory material; and

1–6% by weight of carbonaceous material other than expandable graphite.

10. A granular mould flux as recited in claim 9 further comprising more than zero light weight refractory material.

* * * * *